US008419596B2

(12) United States Patent
Lai

(10) Patent No.: US 8,419,596 B2
(45) Date of Patent: Apr. 16, 2013

(54) EXERCISE MACHINE

(76) Inventor: Ying-Chou Lai, Huatan Township (TW)

( * ) Notice: Subject to any disclaimer, the term of this patent is extended or adjusted under 35 U.S.C. 154(b) by 335 days.

(21) Appl. No.: 12/852,510

(22) Filed: Aug. 8, 2010

(65) Prior Publication Data

US 2012/0035022 A1 Feb. 9, 2012

(51) Int. Cl.
*A63B 22/00* (2006.01)
*A63B 22/04* (2006.01)
*A63B 71/00* (2006.01)

(52) U.S. Cl.
USPC ..... 482/52

(58) Field of Classification Search ..... 482/51–53, 482/57, 62, 70–71
See application file for complete search history.

(56) References Cited

U.S. PATENT DOCUMENTS

| | | | | |
|---|---|---|---|---|
| 5,779,599 | A * | 7/1998 | Chen | 482/57 |
| 5,921,894 | A * | 7/1999 | Eschenbach | 482/57 |
| 6,648,800 | B2 * | 11/2003 | Stearns et al. | 482/52 |
| 6,672,992 | B1 * | 1/2004 | Lo et al. | 482/52 |
| 6,689,021 | B2 * | 2/2004 | Stevens | 482/52 |
| 7,041,036 | B1 * | 5/2006 | Kuo | 482/52 |
| 7,537,548 | B1 * | 5/2009 | Stearns et al. | 482/52 |
| 2007/0087903 | A1 * | 4/2007 | Lee et al. | 482/52 |
| 2007/0238582 | A1 * | 10/2007 | Lee | 482/52 |
| 2009/0048072 | A1 * | 2/2009 | Chuang et al. | 482/52 |
| 2009/0098982 | A1 * | 4/2009 | Yeh | 482/52 |

* cited by examiner

*Primary Examiner* — Oren Ginsberg

(57) ABSTRACT

An exercise machine comprises an oval-shaped structure with a fly wheel, two driving arms, two swing handle and two slidable bars. The fly wheel of the oval-shaped structure simultaneously drives the driving arms and the swing handles, and the slidable bars are pivoted onto the corresponding swing handles and rest on corresponding shafts of the fly wheel such that the movements of the slidable bars are not limited by the driving arms and can be longer than the travel stroke of the fly wheel.

9 Claims, 11 Drawing Sheets

EXERCISE MACHINE

BACKGROUND OF THE INVENTION

1. Field of the Invention

The present invention relates to an exercise machine having an oval-shaped mechanism, and more particularly to an oval-shaped mechanism having driving arms, which can provide a longer and varied stroke with respect to the fly wheel.

2. Description of the Related Art

Currently, a prior art exercise machine, as shown in FIG. 11, comprises: an oval-shaped structure 50, two swing handles 60 and two slidable bars 70. The oval-shaped structure 50 comprises a base 51 having a fly wheel 52, and a standing rod 53 is attached to a front end of the oval-shaped structure 50. The fly wheel 52 has a shaft 521 extending from two sides of the flywheel 52. A pivoting shaft 531 extends from two sides of the standing rod 53. The two swing handles 60 respectively have a gripping portion 61, a linking arm 62 and a connecting tube 63 jacketed onto the pivoting shaft 531 of the standing rod 53. The linking arm 62 has an assembly portion 64 at an opposite end of the gripping portion 61. The slidable bars 70 each have a first pivoting portion 71 for attachment onto the assembly portion 64 of the respective swing handle 60, a second pivoting portion 72 with a ring for jacketing onto the shaft 521 of the fly wheel 52, and a pedal 73 disposed on a predetermined position of each slidable bar 70. When a user wants to operate the exercise machine, he or she needs to stand on both of the pedals 73 of the slidable bars 70 and hold both of the swing handles 60. By swinging both arms and stepping both legs, the fly wheel 52 provides continuous movement and identical travel strokes for the swing handles 60 and the slidable bars 70.

However, the prior art exercise machine has following drawback: since second pivoting portion 72 with a ring is directly jacketed onto the shaft 521 of the fly wheel 52 and the first pivoting portion 71 is attached onto the assembling portion 64 of the swing handle 60, the oval-shaped structure 50 has a travel stroke limited by the fly wheel 52 such that slidable bars 70 and the swing handles 60 have the same travel stroke as the fly wheel 52.

Therefore, it is desirable to provide an exercise machine to mitigate and/or obviate the aforementioned problems.

SUMMARY OF THE INVENTION

An objective of the present invention is to provide an exercise machine having driving arms, which can provide a longer and variously adjustable stroke with respect to the fly wheel.

In order to achieve the above-mentioned objectives, an oval-shaped structure comprises a base having a fly wheel, the fly wheel having a respective shaft eccentrically extending from each of two sides, each shaft jacketed with a sleeve. A standing rod is attached to a front end of the oval-shaped structure, and a respective pivoting shaft extends from each of two sides of the standing rod. Two driving arms are attached to two sides of the oval-shaped structure, respectively, one end of each driving arm having a securing portion and another end having a first pivoting portion with a ring for jacketing onto a corresponding shaft of the fly wheel. Two swing handles each have a gripping portion and a linking arm at two respective ends. A connecting tube disposed between the gripping portion and the linking arm is pivoted onto the pivoting shaft of the standing rod. At least one positioning shaft is disposed on the linking arm for securing the securing portion of a corresponding driving arm. A respective assembling portion is disposed at an end away from each gripping portion. Two slidable bars, each having a second pivoting portion, attach onto a corresponding assembling portion of the swing handles, and a pedal is disposed at a predetermined position on each slidable bar.

With the above-mention structure, the following benefits can be obtained: the fly wheel of the oval-shaped structure provides linkage movements to the driving arms and the swing handles, and each slidable bar utilizes the second pivoting portion for attachment onto the assembling portion of the corresponding swing handle and rests on the corresponding shaft of the fly wheel, such that sliding movements of the slidable bars are not limited by the driving arms and may be longer than the travel stroke of the fly wheel. Therefore, the oval-shaped structure is capable of providing different exercise effects for the users Other objects, advantages, and novel features of the invention will become more apparent from the following detailed description when taken in conjunction with the accompanying drawings.

DETAILED DESCRIPTION OF THE PREFERRED EMBODIMENT

Figure 1:
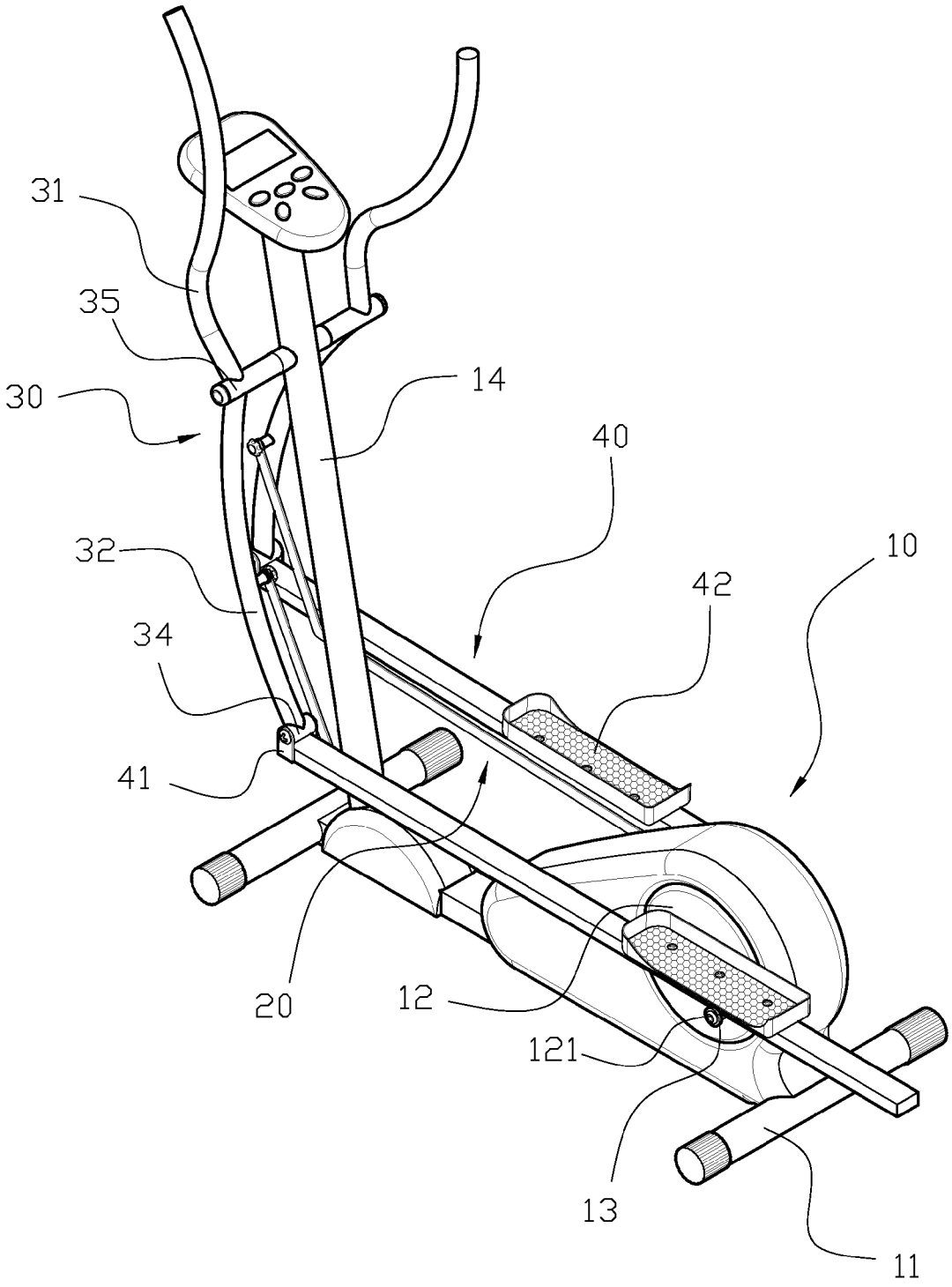
FIG. 1 is a perspective view of an embodiment of the present invention.
Figure 2:
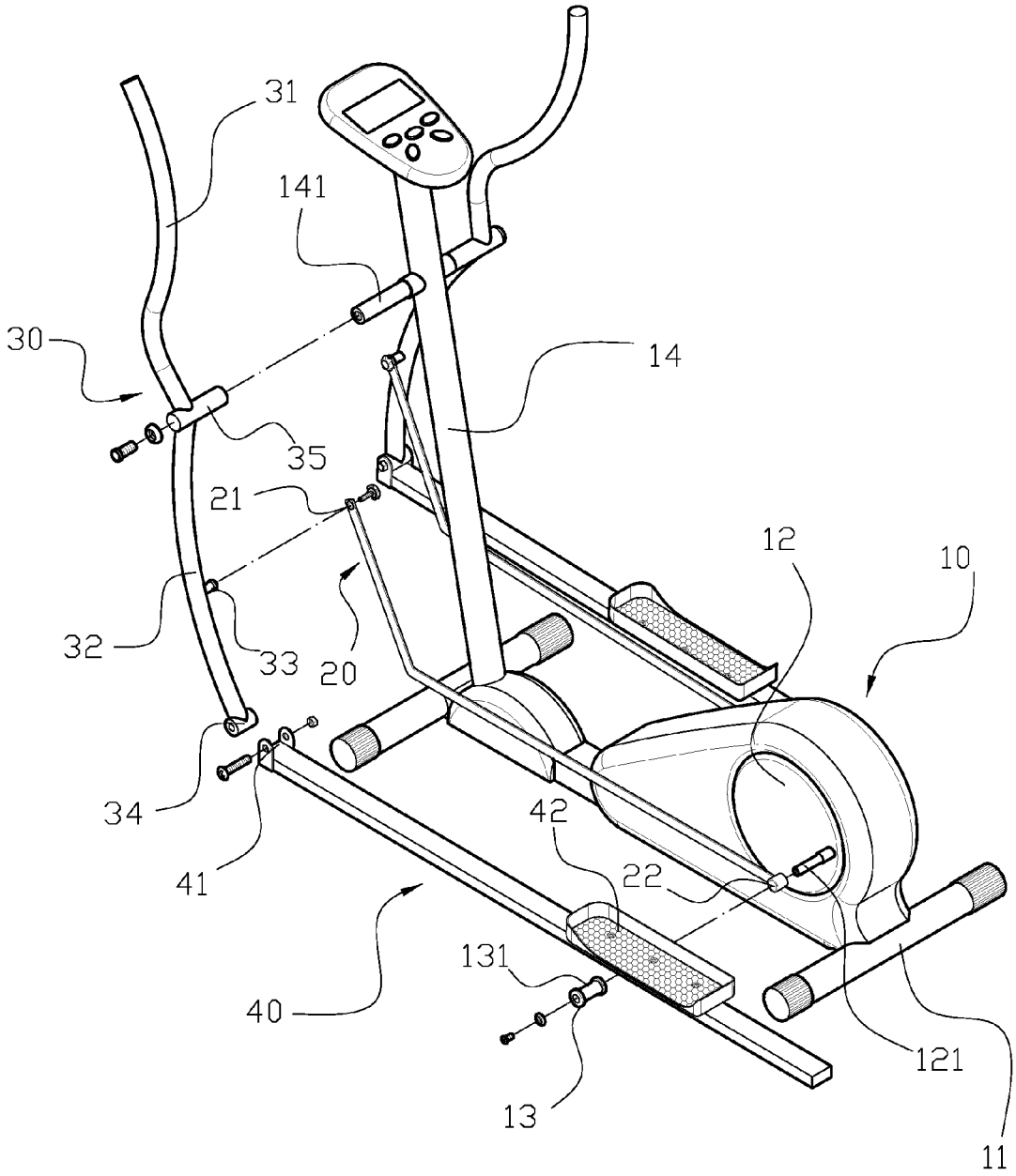
FIG. 2 is an exploded view of an embodiment of the present invention.

Please refer to FIG. 1 and FIG. 2. An embodiment exercise machine comprises an oval-shaped structure 10, two driving arms 20, two swing handles 30 and two slidable bars 40. The oval-shaped structure 10 comprises a base 11 having a fly wheel 12. The fly wheel 12 has a shaft 121 respectively eccentrically extending from each of two opposing sides of fly wheel 12; a sleeve 13 is jacketed onto each shaft 121, and a limiting track 131 is formed between the peripheries of the sleeve 13 and used for securing the slidable bar 40. A standing rod 14 is attached to a front end of the oval-shaped structure 10, and a pivoting shaft 141 extends from each of two opposing sides of the standing rod 14. Each pivoting shaft 141 has a threaded aperture and corresponding screws. Each of the two driving arms 20 is respectively attached to a corresponding one of the two sides of the oval-shaped structure 10; each driving arm 20 has a securing portion 21 at one end and a first pivoting portion 22 at another end that has a ring for jacketing onto a corresponding shaft 121 of the fly wheel 12. Moreover, each driving arm 20 is bent to form an obtuse angle between the securing portion 21 and the first pivoting portion 22. The two swing handles 30 each have a gripping portion 31 and a linking arm 32 on opposing sides; a connecting tube 35 is disposed between the gripping portion 31 and the linking arm 32, and at least one positioning shaft 33 is disposed on each linking arm 32 for securing the securing portion 21 of a corresponding driving arm 20. Each swing handle 30 also has an assembling portion 34 at an end opposite the gripping portion 32. The two slidable bars 40 are each a long board that is narrower than the limiting track 131 of the corresponding sleeve 13 and each slidable bar 40 has a second pivoting portion 41 for attaching onto the assembling portion 34 of a corresponding swing handle 30, and a respective pedal 42 is disposed at a predetermined position on each slidable bar 40.

For assembly, please refer to FIG. 1 and FIG. 2. The two driving arms 20 are each attached to a corresponding side of the oval-shaped structure 10, and the pivoting portions 22 are each jacketed onto a corresponding shaft 121 of the fly wheel 12. Each shaft 121 utilizes the corresponding sleeve 13 for securing of the pivoting portion 22. The two swing handles 30 are also each coupled to corresponding side of the oval-shaped structure 10, and each utilizes the connecting tube 35 for jacketing onto a corresponding pivoting shaft 141 on a respective side of the standing rod 14, and each is then secured by a respective screw. Each linking arm 32 utilizes the positioning shaft 33 for mounting of the securing portion 21 of a respective driving arm 20. The two slidable bars 40 are also each attached to a corresponding side of the oval-shaped structure 10, respectively utilizing the corresponding second pivoting portion 41 for pivoting onto the assembling portion 34 of the respective swing handle 30, and are each placed in the respective limiting track 131 of the sleeve 13.

Figure 3:
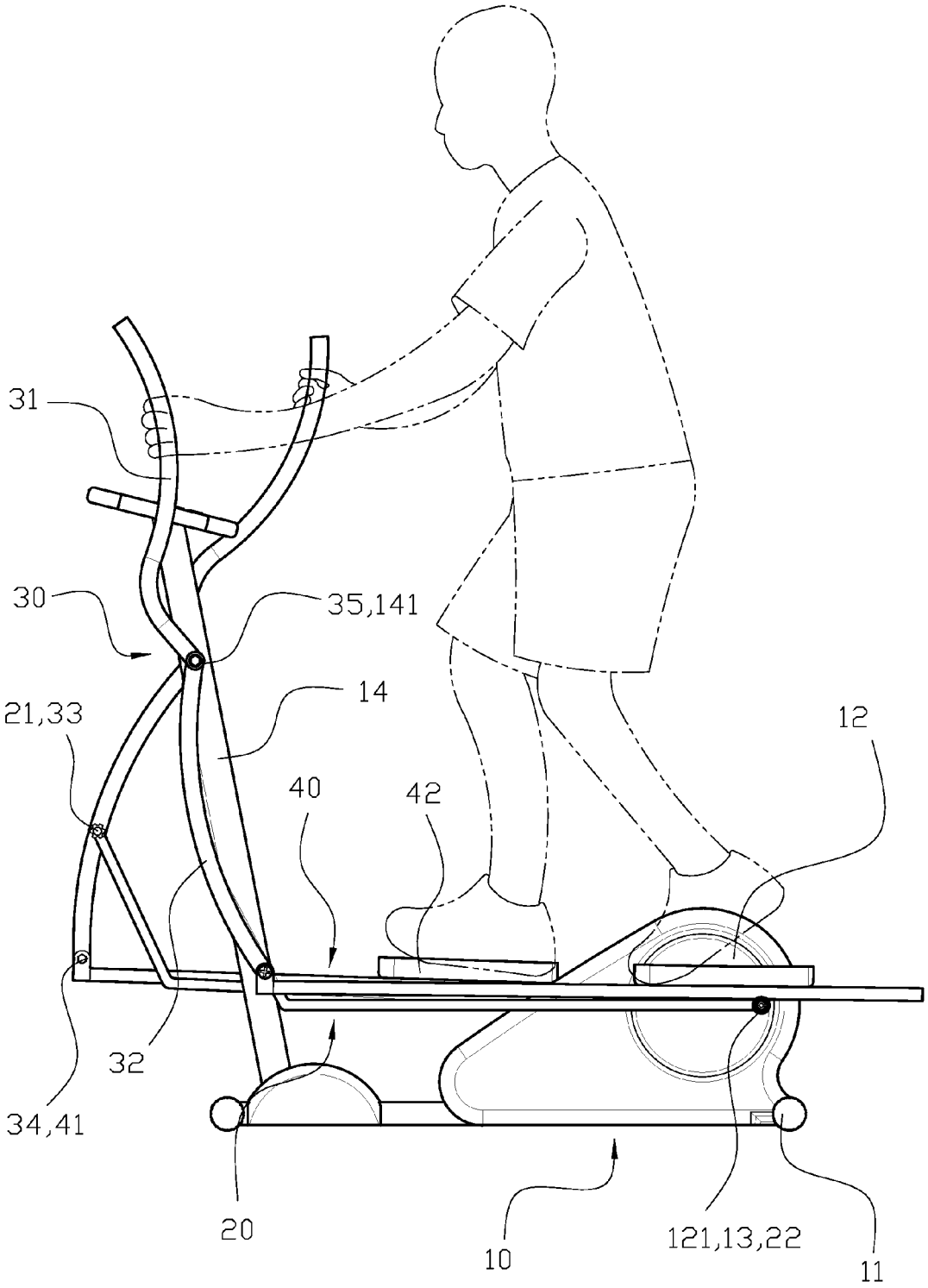
FIG. 3 is a side view illustrating operation of an embodiment of the present invention.
Figure 4:
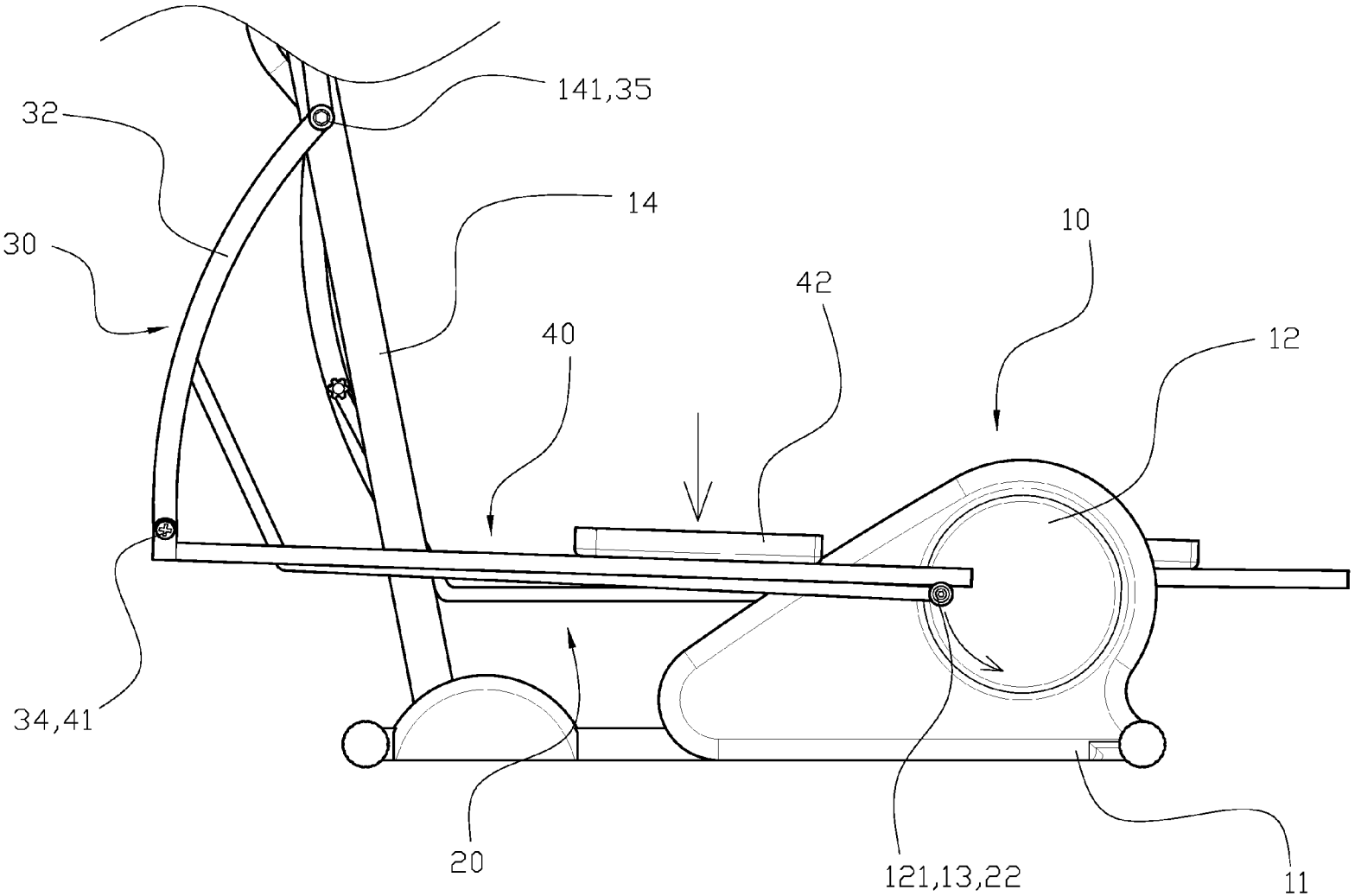
FIG. 4 is a side view illustrating continuous movement of an embodiment of the present invention.
Figure 5:
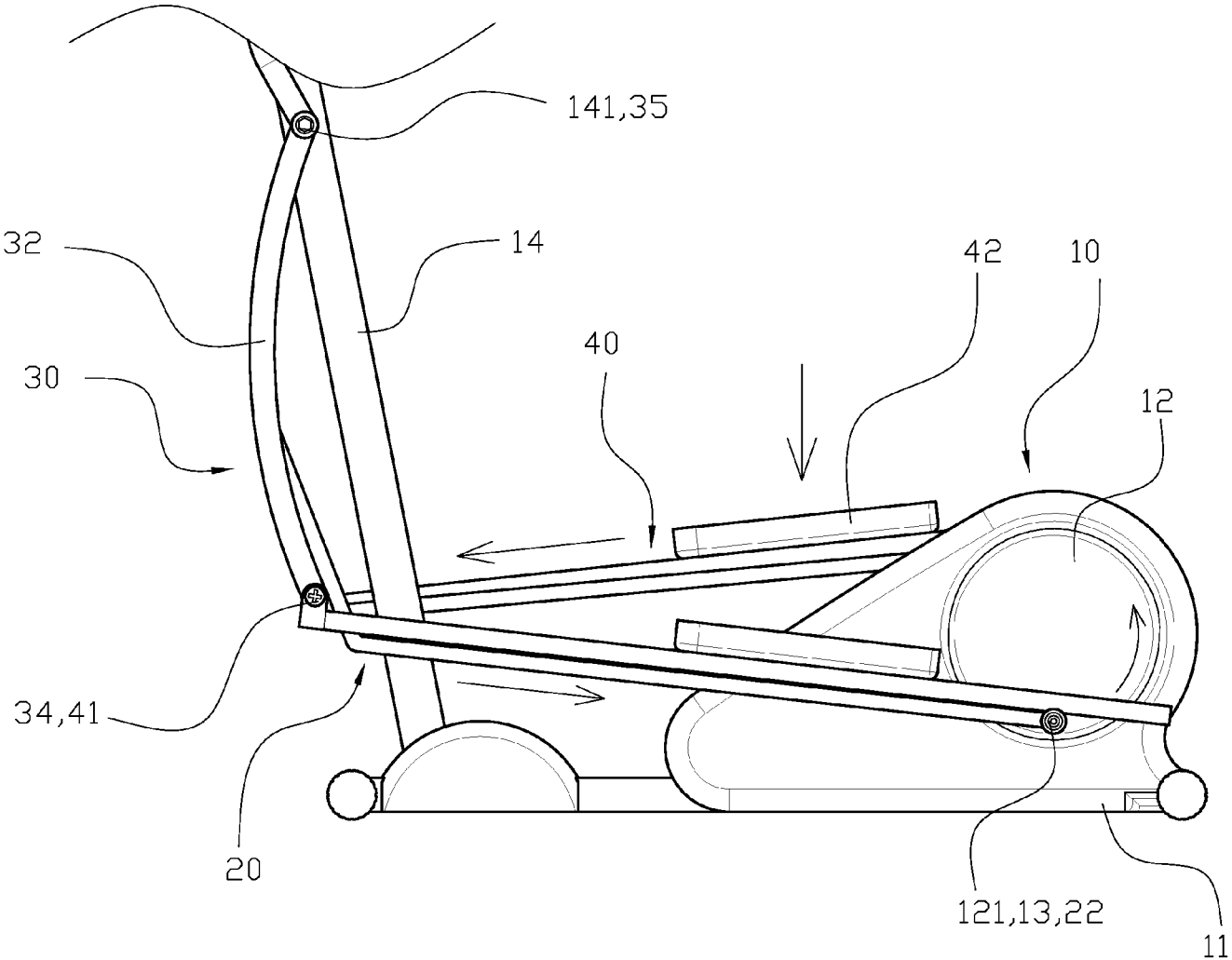
FIG. 5 is another side view illustrating continuous movement of an embodiment of the present invention.
Figure 6:
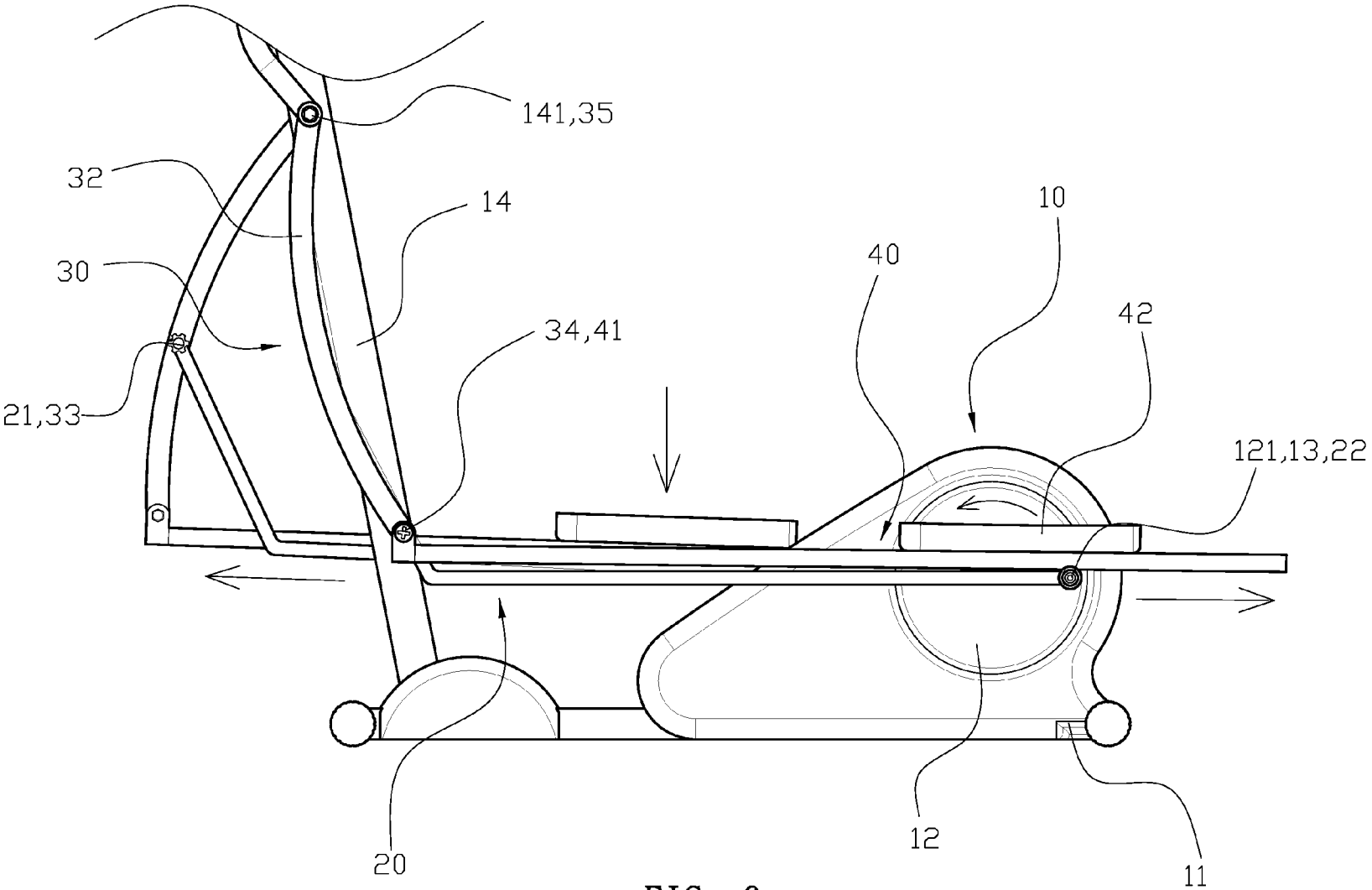
FIG. 6 is another side view illustrating continuous movement of an embodiment of the present invention.

For operations, please refer to FIG. 3 together with FIGS. 4-6. A user stands on both of the pedals 43 of the slidable bars 40 and holds both of the gripping portions 31 of the swing handles 30; the user then swings both arms and employs a stepping motion with both legs. The pivoting portions 22 of the driving arms 20 are jacketed onto the shafts 121 of the fly wheel 12, and the securing portions 21 are mounted onto the positioning shafts 33 of the swing handles 30, such that each driving arm 20 is connected to both the fly wheel 12 and the respective swing handle 30. The slidable bars 40 utilize the second pivoting portions 41 for attaching onto the assembling portions 34 of the swing handles 30, such that the slidable bars 40 and driving arms 20 utilize different pivoting points for swinging movements and both overlap each other to rest on the corresponding sleeves 13 of the shafts 121 of the flywheel 12; therefore, when the user steps with both feet and swings with both hands, with the free joints formed by the second pivoting portions 41 of the slidable bars 40 and the assembling portions 34 of the swing handles 30, the movements of the slidable bars 40 are not limited by the sleeves 13 of the shafts 121, such that the swing handles 30 and the slidable bars 40 are capable of having travel strokes that are longer than the travel stroke of the fly wheel 12.

Figure 7:
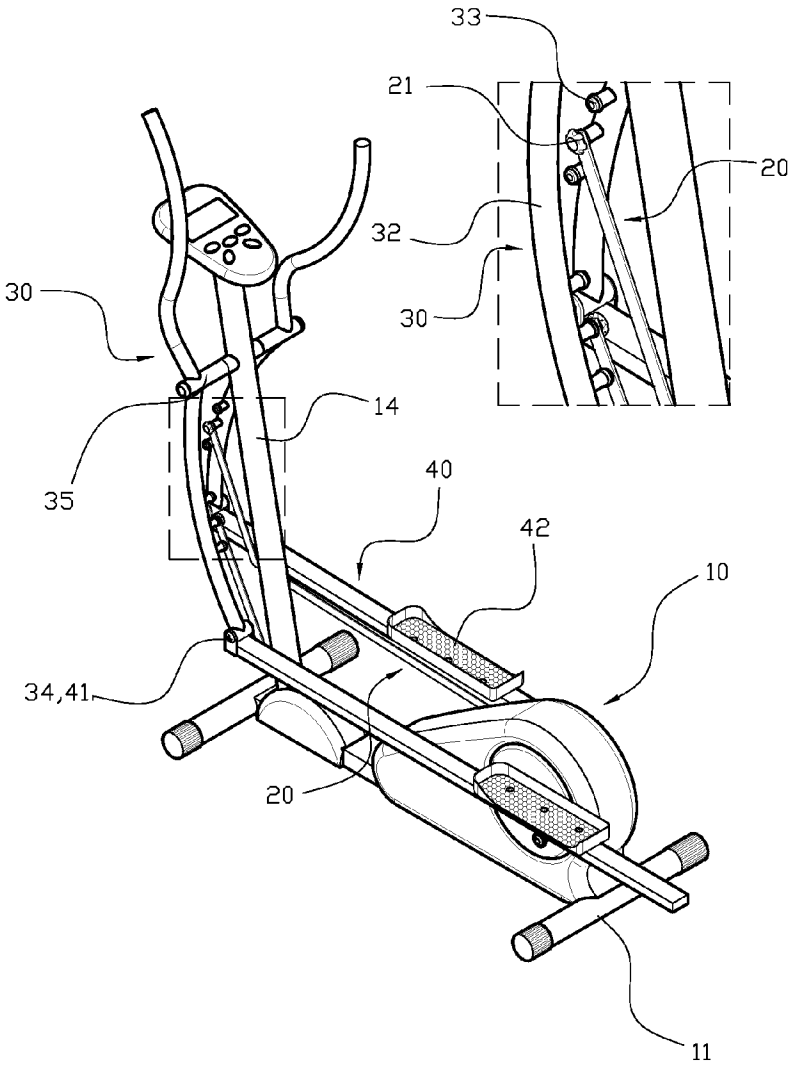
FIG. 7 is a local detailed view of a first embodiment of the present invention.

For a second embodiment of the exercise machine, please refer to FIG. 7. A plurality of positioning shafts 33 are disposed on a side of the linking arm 32 of each swing handle 30 such that the securing portion 21 of the respective driving arm 20 is adjustable for connection to any of the positioning shafts 33 of the linking arm 30.

Figure 8:
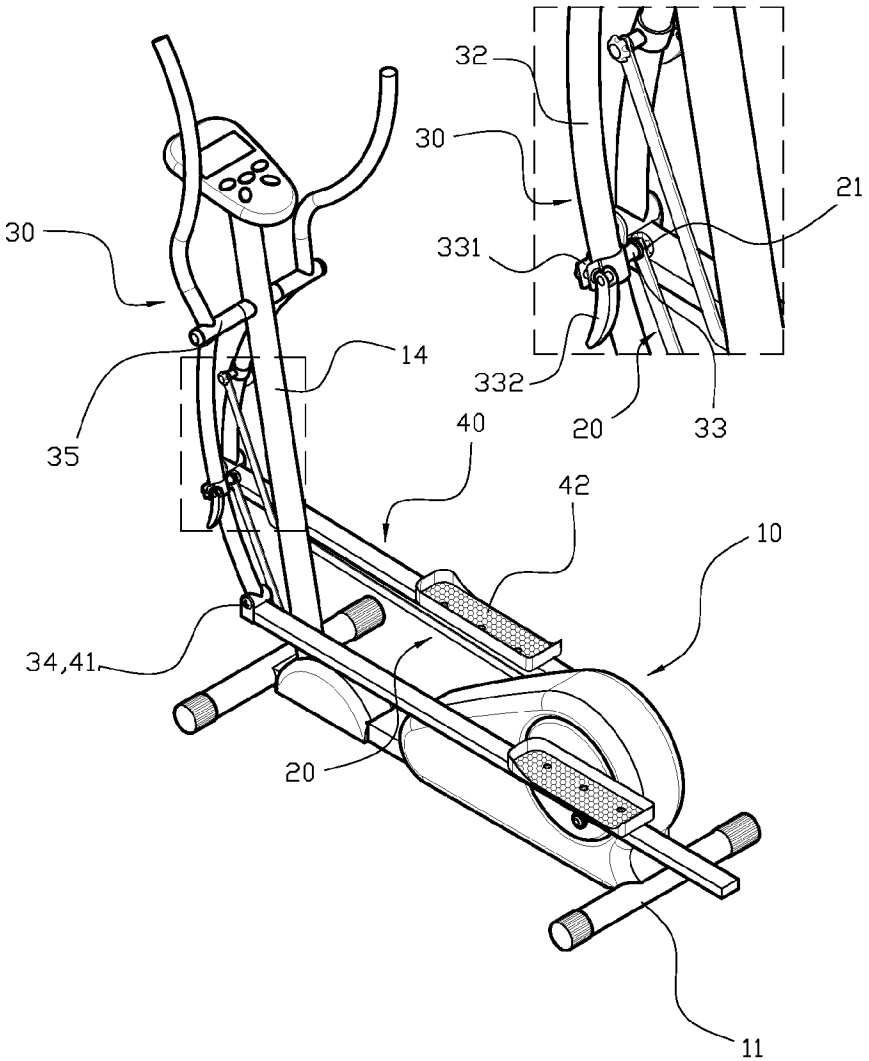
FIG. 8 is a local detailed view of a second embodiment of the present invention.
Figure 9:
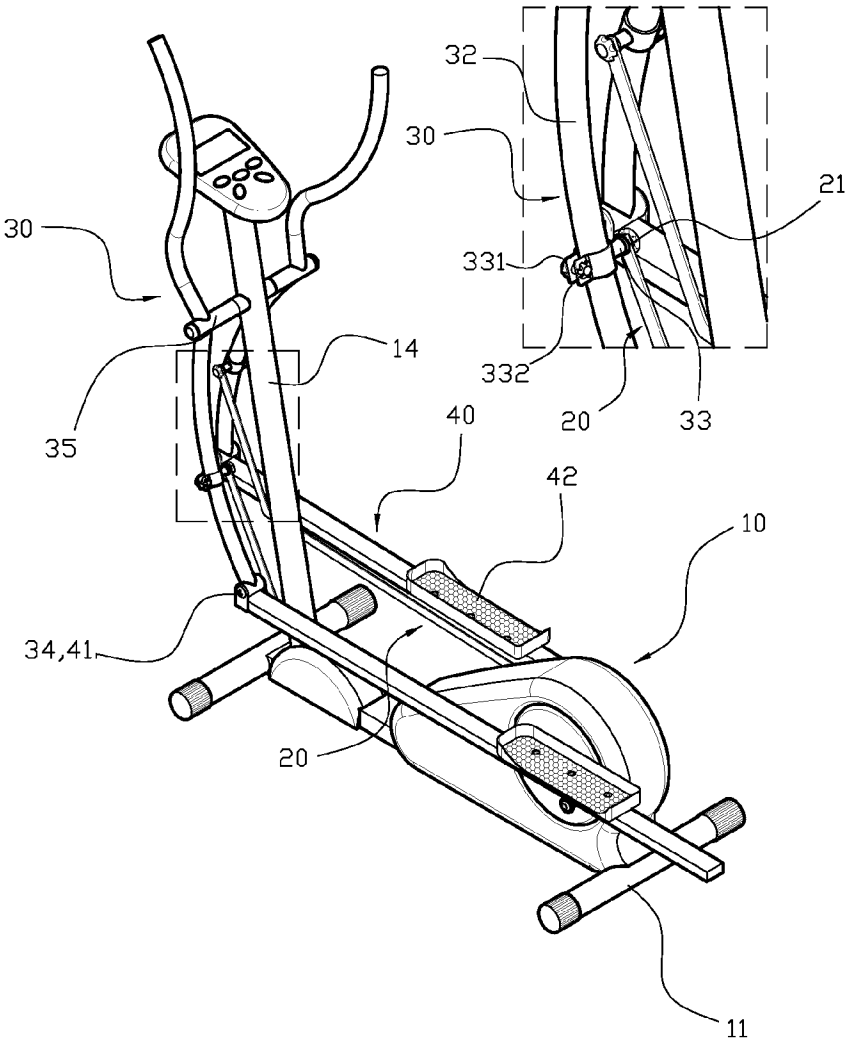
FIG. 9 is a local detailed view of a third embodiment of the present invention.
Figure 10:
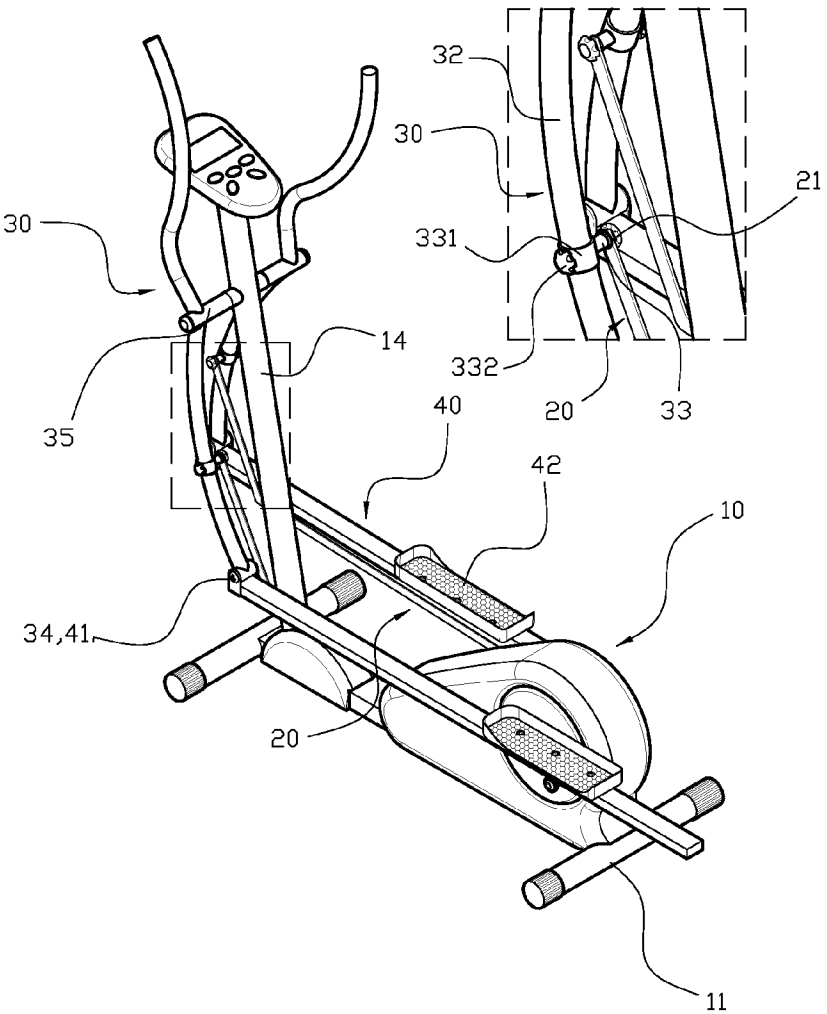
FIG. 10 is a local detailed view of a fourth embodiment of the present invention
Figure 11:
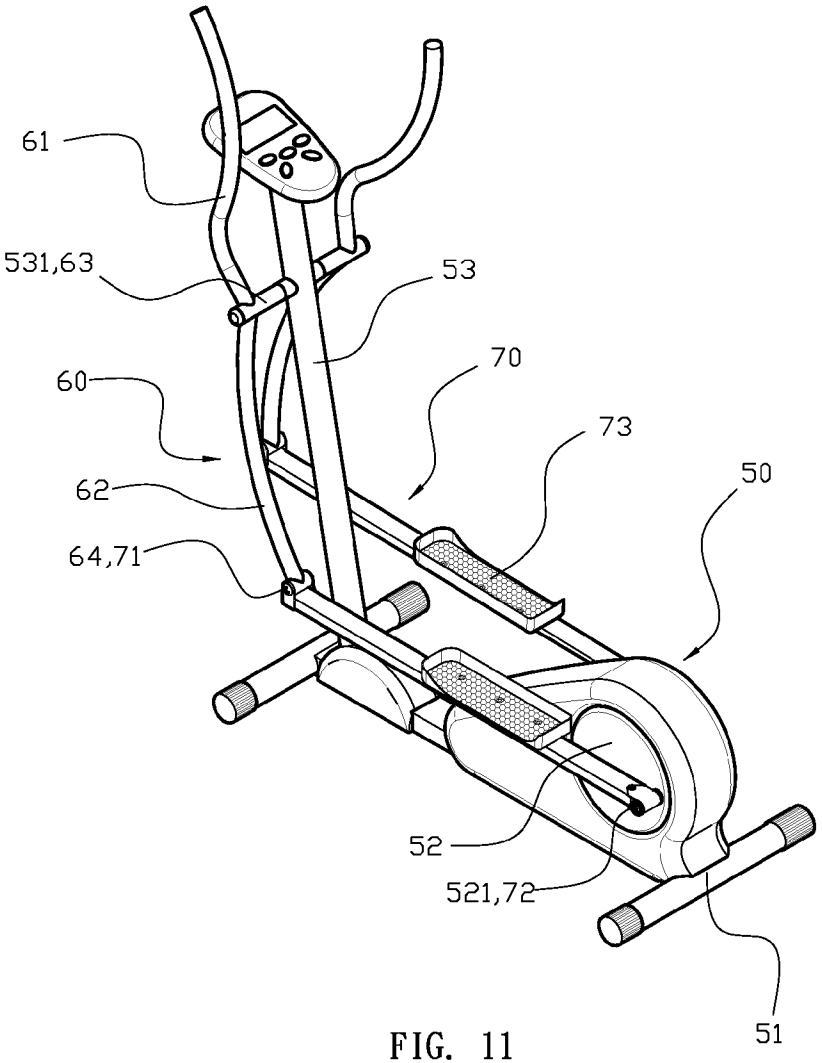
FIG. 11 PRIOR ART
FIG. 11 is a perspective view of a prior art device.

For others embodiments of the exercise machine, please refer to FIGS. 8, 9, and 10. A moveable securing member 331 and a corresponding positioning member 332 are attached onto each linking arm 32, and a positioning shaft 33 is disposed on the linking arm 32 for securing the securing portion 21 of the respective driving arm 20, such that the positioning shaft 33 can be moved along the linking arm 32 with the securing member 331, and be attached to the securing portion 21 of the driving arms 20 and secured into place by the positioning member 332. Therefore, the travel distance of the linking arm 32 can be changed. The positioning member 332 can be a quick-release member, a locking member or a tightening member.

With the above-mentioned structure the following benefits can be obtained: the fly wheel 12 of the oval-shaped structure 10 provides linkage movements to the driving arms 20 and the swing handles 30, the slidable bars 40 utilize the second pivoting portions 41 for attachment onto the assembling portions 34 of the swing handles 30 and rest on the shafts 121 of the fly wheel 12, such that the sliding movements of the slidable bars 40 are not limited by the driving arms 20 and may be longer than the travel stroke of the fly wheel 12. Therefore, the oval-shaped structure 10 is capable of providing different exercise effects to the users.

Although the present invention has been explained in relation to its preferred embodiment, it is to be understood that many other possible modifications and variations can be made without departing from the spirit and scope of the invention as hereinafter claimed.

What is claimed is:

1. An exercise machine comprising:

an oval-shaped structure comprising a base having a fly wheel, the fly wheel having a shaft eccentrically connected to and extending from each of two sides, each shaft jacketed with a respective sleeve, a standing rod attached to a front end of the oval-shaped structure, and a pivoting shaft extending from each of two sides of the standing rod;

two driving arms, each driving arm attached to a corresponding side of the oval-shaped structure, an end of each driving arm having a securing portion and another end having a first pivoting portion with a ring for jacketing onto a corresponding shaft of the fly wheel;

two swing handles, each swing handle having a gripping portion and a linking arm on opposing sides, a connecting tube disposed between the gripping portion and the linking arm and pivoted onto a corresponding pivoting shaft of the standing rod, a plurality of positioning shafts disposed on the linking arm for selectively securing the securing portion of a corresponding driving arm, and an assembling portion at an end opposite from the gripping portion, wherein the plurality of positioning shafts on each linking arm face the plurality of positioning shafts on the other linking arm; and two slidable bars, each slidable bar having a second pivoting portion for attaching onto the assembling portion of a corresponding swing handle, and further including a pedal disposed at a predetermined position on the slidable bar;

wherein the securing portion of each driving arm is adjustable for connecting to any of the positioning shafts of the corresponding linking arm, and each driving arm is bent to form an obtuse angle between the securing portion and the first pivoting portion.

2. The exercise machine as claimed in claim 1, wherein a limiting track is formed within the peripheries of each sleeve for securing the corresponding slidable bar.

3. The exercise machine as claimed in claim 1, wherein each pivoting shaft has a threaded aperture and a corresponding screw.

4. An oval-shaped mechanism comprising:

a base having a fly wheel, the fly wheel having a shaft eccentrically connected to and extending from each of two sides, each shaft jacketed with a corresponding sleeve, a standing rod attached to a front end of the oval-shaped mechanism, and a pivoting shaft extending from each of two sides of the standing rod;

two driving arms, each driving arm attached to a corresponding side of the oval-shaped mechanism, an end of each driving arm having a securing portion and another end having a first pivoting portion with a ring for jacketing onto a corresponding shaft of the fly wheel;

two swing handles, each swing handle having a gripping portion and a linking arm, and an assembling portion at an end opposite the gripping portion, a connecting tube disposed between the gripping portion and the linking arm and pivoted onto a corresponding pivoting shaft of the standing rod;

a moveable securing member attached onto each linking arm for securing the securing portion of the corresponding driving arm, wherein the securing portions of the driving arms face each other between the linking arms; and two slidable bars, each slidable bar having a second pivoting portion for attaching onto the assembling portion of a corresponding swing handle and a pedal disposed at a predetermined position;

wherein a position of each securing portion is adjustable on the corresponding linking arm using the securing member, and each driving arm is bent to form an obtuse angle between the securing portion and the first pivoting portion.

5. The oval-shaped mechanism as claimed in claim 4, wherein each securing member is a quick-release member capable of locking onto the corresponding linking arm.

6. The oval-shaped mechanism as claimed in claim 4, wherein each securing member is a locking member capable of locking onto the corresponding linking arm.

7. The oval-shaped mechanism as claimed in claim 4, wherein each securing member comprises a tightening member capable of locking onto the corresponding linking arm.

8. The oval-shaped mechanism as claimed in claim 4, wherein a limiting track is formed between the peripheries of each sleeve for securing the corresponding slidable bar.

9. The oval-shaped mechanism as claimed in claim 4, wherein each pivoting shaft has a threaded aperture and a screw.

* * * * *